US005410825A

United States Patent [19]

Perrelli

[11] Patent Number: 5,410,825

[45] Date of Patent: May 2, 1995

[54] SELF-PROPELLED SNOWTHROWER

[76] Inventor: Michael J. Perrelli, 312 N. Wrexham Ct., Tonawanda, N.Y. 14150

[21] Appl. No.: 140,485

[22] Filed: Oct. 25, 1993

[51] Int. Cl.[6] ..... E01H 5/09

[52] U.S. Cl. ..... 37/254; 37/232; 37/248

[58] Field of Search ..... 37/232, 233, 244, 253, 37/254, 256, 257, 258, 243, 247, 248, 249, 250, 251; 172/42, 71, 72, 121; 56/320.1, DIG. 24, DIG. 20

[56] References Cited

U.S. PATENT DOCUMENTS

| | | | |
|---|---|---|---|
| 1,577,322 | 3/1926 | Laing | 37/233 |
| 1,655,136 | 1/1928 | Criley | 37/233 |
| 1,724,692 | 8/1929 | Bassler | 37/253 |
| 2,055,291 | 9/1936 | Henry | 37/233 |
| 2,116,351 | 5/1938 | Jones et al. | 37/233 |
| 2,587,415 | 2/1952 | Vanvick | 37/53 |
| 2,751,831 | 6/1956 | Null | 37/244 X |
| 2,962,821 | 12/1960 | Peitl | 37/233 |
| 3,126,652 | 3/1964 | Reissinger | 37/233 |
| 3,400,475 | 9/1968 | Peitl | 37/233 |
| 3,808,714 | 5/1974 | Reissinger et al. | 37/233 |
| 4,694,594 | 9/1987 | Thorud et al. | 37/244 |
| 4,899,471 | 2/1990 | Sasaki | 37/233 |
| 4,908,968 | 3/1990 | Thorud et al. | 37/233 |
| 5,109,618 | 5/1992 | Grübler et al. | 37/232 |
| 5,123,186 | 6/1992 | Matushita | 37/257 X |

FOREIGN PATENT DOCUMENTS

| | | | |
|---|---|---|---|
| 1435679 | 11/1988 | U.S.S.R. | 37/244 |

*Primary Examiner*—David H. Corbin
*Assistant Examiner*—Victor Batson
*Attorney, Agent, or Firm*—Bean, Kauffman & Spencer

[57] ABSTRACT

An improved snowthrower is disclosed having a body with a front housing containing a power driven auger continuously engaged with the ground for propelling the snowthrower forward, and a bottom scraper edge carried by a rear wall of the housing biased for continuous resilient engagement with the ground. In a preferred embodiment, the housing is pivotally connected to the snowthrower body by a fixed mounting bracket and springs connected to the housing and mounting bracket pivotally urge the housing such that the scraper edge is biased for continuous contact with the ground. In a second embodiment, the housing is fixed directly to the snowthrower body, a scraper guard plate having a bottom scraper edge is slidably attached to the rear wall of the housing, and springs connected to the housing and the scraper guard plate slidably urge the scraper guard plate such that the scraper edge is biased for continuous contact with the ground.

5 Claims, 2 Drawing Sheets

SELF-PROPELLED SNOWTHROWER

BACKGROUND OF THE INVENTION

Conventional snowthrowers generally include a wheel supported body or frame having a drive means for rotating an auger or impeller located within a fixed housing including a pair of opposing side walls, a top wall and a rear wall, which cooperate to define a downwardly and forwardly projecting snow-receiving opening. Snow is introduced into the housing by operation of the auger and then expelled therefrom through a chute connected to the top wall of the housing.

In the absence of the provision of a drive train between the drive means of a conventional snowthrower and its supporting wheels, it is normally necessary for an operator to constantly grip a handle assembly and apply constant manual forward force to push the snowthrower forward. With regard to such snowthrowers, it has been recognized, as for example in U.S. Pat. Nos. 2,587,415 and 4,694,594, that the rotating auger may be used as a temporary drive mechanism for propelling the snowthrower over obstructions, but this requires the operator to lift the handle assembly in order to rotate or tilt the complete snowthrower forward sufficiently to place the rotating auger in engagement with the ground. While this technique may be temporarily used to propel the snowthrower over unyielding obstructions or irregular terrain, it is not suitable for constant normal use. First, in this respect, forward tilting of the snowthrower tends to create a wide gap between the ground and the bottom of the rear wall of the housing through which snow, ice, stones, etc. may be thrown from the interior of the housing back toward the operator, endangering the operator and leaving a vast, unwanted trail of snow. Second, the operator is in great danger of walking into and inadvertently placing a foot through the exposed wide gap and into the rotating auger when lifting the handle assembly. Third, the operator is susceptible to muscle fatigue from constantly lifting the handle assembly and snowthrower to engage the auger with the ground for extended periods.

SUMMARY OF THE INVENTION

The present invention generally relates to snowthrowers, and more particularly to an improved self-propelled snowthrower having a bottom scraper edge which is biased for constant and continuous contact with the ground.

The invention may be practiced by modification of a conventional snowthrower of the type generally comprising a wheel supported body having a handle assembly, drive means for rotatably driving an auger located within a housing having a pair of opposing side walls, a top wall, and a rear wall cooperating to define a forwardly and downwardly projecting opening, and a chute connected to the top wall. The snowthrower is modified by providing an auger which extends below bottom edges of the housing side walls for permanent engagement with the ground such that rotation of the auger acts to propel the snowthrower forward, and by biasing a bottom scraper edge associated with the rear wall for continuous contact with the ground.

In accordance with a preferred embodiment of the present invention, the scraper edge is fixed to the rear wall of the housing, the housing is pivotally connected to the snowthrower body by a mounting bracket, and biasing means is provided for urging the housing in a first pivotal direction to bias the bottom scraper edge for continuous contact with the ground.

The scraper edge may be a bottom edge of a scraper guard plate fixedly attached to the rear wall of the housing such that the scraper edge is flush with or extends below a bottom edge of the rear wall, or the scraper edge may comprise the bottom edge of the rear wall. The mounting bracket is U-shaped and has a base portion fixed to the front and bottom of the snowthrower body, and a pair of opposing leg portions extending generally forward and downward from opposite ends of the base portion at substantially right angles thereto. The auger axle is rotatably journalled by the opposing leg portions of the mounting bracket, and the housing is pivotally mounted on the axle or directly to the mounting bracket between the opposing leg portions for pivotal movement about the rotational axis of the auger. Biasing means for urging the housing in its first pivotal direction preferably comprises a plurality of springs having one end connected to the housing and another end connected to the mounting bracket, such that loading of the springs occurs incident to movement of the housing in a second pivotal direction opposite the first pivotal direction.

The preferred embodiment additionally includes pivot safety stop means comprising first and second abutment stops fixed to a side wall of the housing and respectively arranged to engage with a leg portion of the mounting bracket incident to pivotal motion of the housing in its first and second pivotal directions, thereby limiting the range of pivotal motion of the housing about the axis of rotation of the auger.

In accordance with a second embodiment of the present invention, an alternative means is employed to support and bias the scraper edge toward continuous contact with the ground. In the second embodiment, the housing is fixed directly to the snowthrower body without a U-shaped mounting bracket, and a scraper guard plate is slidably attached to the rear wall of the housing. The scraper guard plate is urged by biasing means, such that the scraper edge is biased for continuous contact with the ground.

In the second embodiment, attachment means for slidably attaching the scraper guard plate to the rear wall preferably includes a plurality of horizontally spaced, vertically elongated travel slots through the scraper guard plate, and a pair of headed guide pins such as bolts extending through each travel slot and connecting the scraper guard plate to the housing along the rear wall, such that the scraper guard plate may travel along a generally vertical travel path defined by the travel slots. Biasing means for urging the scraper guard plate preferably comprises a plurality of springs having one end connected to the rear wall of the housing and another end connected to the scraper guard plate.

With respect to both embodiments summarized above, the auger of the improved snowthrower is permanently positioned to engage the ground for propelling the snowthrower forward, such that no lifting or pushing of the handle assembly is required to engage the auger with the ground, thereby eliminating potential muscle fatigue. Since, in both embodiments, the snowthrower propels itself and the scraper edge is maintained in substantially continuous contact with the ground during operation to preclude a gap between the ground and the scraper edge, snow, ice, stones, etc. are prevented from being thrown back toward the operator, and the danger that the operator might walk into or place a foot into the path of the exposed rotating auger is effectively minimized.

BRIEF DESCRIPTION OF THE DRAWINGS

The nature and mode of operation of the present invention will now be more fully described in the following detailed description taken with the accompanying drawings wherein.

DETAILED DESCRIPTION

Figure 1A:
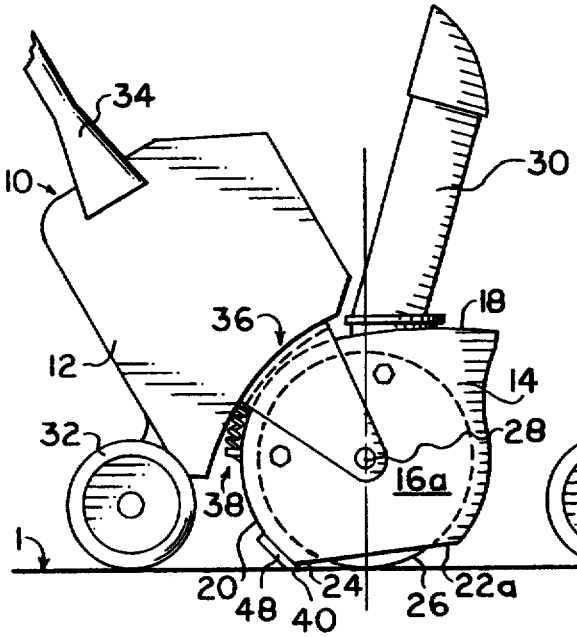
FIG. 1*a* is a side elevational view of a snowthrower formed in accordance with a preferred embodiment of the present invention showing the snowthrower on flat ground with the snowthrower housing in an intermediate pivotal position.
Figure 1B:
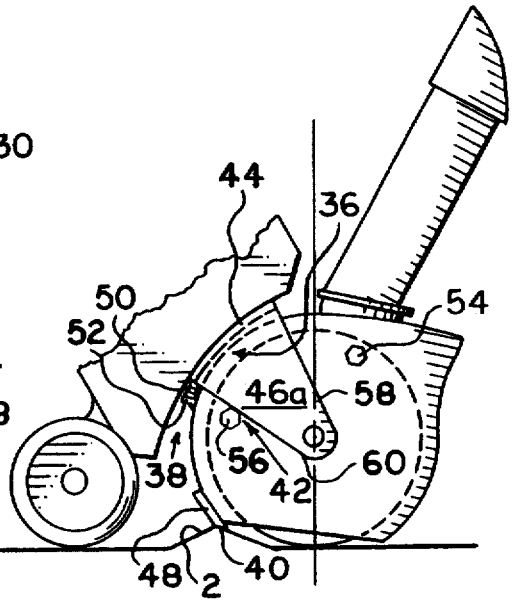
FIG. 1*b* is a view similar to FIG. 1*a*, but showing the snowthrower traversing a ground obstruction with the snowthrower housing in its maximum edge-upward pivotal position.
Figure 2:
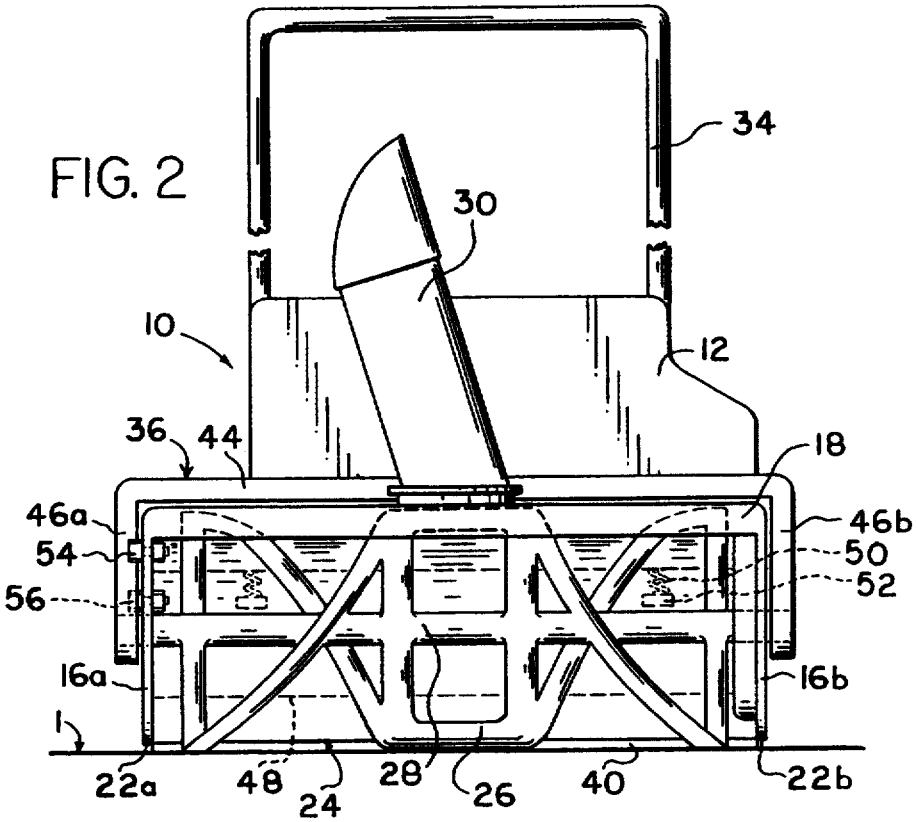
FIG. 2 is a front elevational view of a snowthrower formed in accordance with the preferred embodiment.

Reference is first made to FIGS. 1*a*, 1*b*, and 2, wherein an improved snowthrower incorporating a preferred embodiment of the present invention is shown on ground 1 and generally designated as 10. Snowthrower 10 is shown as generally including a body 12 with a housing 14 located at the front and bottom thereof. Housing 14 includes a pair of opposing side walls 16*a* and 16*b*, a top wall 18, and a rear wall 20 cooperating to define a downwardly and forwardly projecting snow-receiving opening in the housing. Side walls 16*a* and 16*b* include bottom side edges 22*a* and 22*b*, respectively, and rear wall 20 includes a bottom rear edge 24. An auger 26 is carried by an axle 28, which is rotatably mounted between housing side walls 16*a* and 16*b*. Auger 26 is arranged to extend slightly below side edges 22*a* and 22*b* and engage the ground 1, and is preferably of a construction suited for permanent use as a propelling means for snowthrower 10. A drive means (not shown) located on body 12 is connected to axle 28 to rotatably drive auger 26 in a conventional manner, causing the auger to rotate clockwise as shown in FIG. 1*a* to introduce snow into housing 14 and expel the snow from the housing through a chute 30 opening through housing top wall 18. Snowthrower 10 is supported by a pair of spaced rear wheels 32 and includes a handle assembly 34.

In accordance with a preferred embodiment of the present invention, housing 14 is pivotally connected to the front and bottom of snowthrower body 12 by a mounting bracket 36, and biasing means 38 is connected to the housing 14 and the mounting bracket 36 to urge the housing in a first pivotal direction, i.e. counterclockwise as shown in FIGS. 1*a* and 1*b*, to bias a scraper edge 40 carried by housing rear wall 20 for continuous contact with the ground 1. A pivot safety stop means 42 is preferably provided for limiting the range of pivotal motion of housing 14 about the axis of rotation of auger 26.

Mounting bracket 36 is generally U-shaped and includes an elongated base portion 44 fixed to the front and bottom of body 12, and a pair of opposing leg portions 46*a* and 46*b* extending generally forward and downward from opposite ends of base portion 44 at substantially right angles to the base portion. Axle 28 is rotatably journalled by leg portions 46*a* and 46*b*, and housing 14 may be pivotally mounted on axle 28 between leg portions 46*a* and 46*b*. In the alternative, housing 14 may be pivotally mounted directly on bracket 36 between leg portions 46*a* and 46*b* for pivotal movement about the axis of rotation of auger 26.

Scraper edge 40 is preferably the bottom edge of a scraper guard plate 48 which is fixed for movement with housing 14 and arranged to extend laterally along rear wall 20 such that scraper edge 40 is flush with or extends below the rear edge 24 of housing 14. Scraper guard plate 48 is preferably fabricated from a material having suitable strength and wear resistance, such as hard composition plastic. Alternatively, the scraper edge 40 may be integrally formed with housing rear wall 20 such that rear edge 24 comprises scraper edge 40. However, a separately fabricated scraper guard plate is preferable because it prevents wear on the rear edge 24 of housing 14. Scraper edge 40 is angled downward and forward such that horizontally directed force encountered by scraper edge 40 during forward motion of snowthrower 10 will be translated into pivotal motion of housing 14 about the axis of rotation of auger 26.

Biasing means 38 preferably comprises a plurality of coiled compression springs 50 mounted at one end to a spring mount 52 fixed to the exterior surface of rear wall 20, and at the opposite end to the base portion 44 of mounting bracket 36. Springs 50 are preferably spaced laterally along rear wall 20 so as to evenly distribute the biasing force exerted on housing 14. Alternatively, springs 50 may be fixed at one end to side walls 16*a* and 16*b* rearward of leg portions 46*a* and 46*b*, respectively, with the other end of each spring being fixed to the respective leg portion. The number of springs 50, and the stiffness of the springs, are preferably chosen to provide sufficient biasing force to maintain scraper edge 40 in continuous contact with the ground during forward movement of snowthrower 10.

When snowthrower 10 is on flat ground, as shown in FIG. 1*a*, springs 50 are preferably in a state of intermediate compression or loading to bias scraper edge 40 for contact with the ground. Further compression or loading of springs 50 occurs as housing 14 is forced to pivot in a second pivotal direction, i.e. clockwise as shown in FIG. 1*b*, when scraper edge 40 encounters an unyielding obstruction or change in ground terrain 2, thereby allowing the snowthrower to traverse the obstruction. When scraper edge 40 encounters a trough or recess (not shown) in the ground, the intermediately loaded springs 50 urge housing 14 in its first pivotal direction to maintain scraper edge 40 in contact with the recessed ground.

Pivot safety stop means 42 preferably comprises a first abutment stop 54 fixed to housing 14 and arranged to engage with leg portion 46*a* of mounting bracket 36 incident to movement of housing 14 in its first pivotal direction, and a second abutment stop 56 fixed to housing 14 and arranged to engage with leg portion 46*a* incident to movement of housing 14 in its second pivotal direction. Abutment stops 54 and 56 are preferably in the form of protrusions fixed to side wall 16*a* and extending outward therefrom to engage with perimeter edges 58 and 60 of leg portion 46*a*, respectively, and may be part of a suitably sized bolt set through side wall 16*a*, such as a bolt head. It is understood that abutment stops 54 and 56 may be located on opposite side wall **16*b* to engage with opposite leg portion 46*b* without straying from the spirit and scope of the invention. First abutment stop 54 is suitably placed to permit some movement of housing 14 in its first pivotal direction when scraper edge 40 encounters a recess. Depending on the construction of snowthrower 10, it may be desirable to position first abutment stop 54 so that it prevents chute 30 from being driven against snowthrower body 12 during movement of housing 14 its first pivotal direction. Second abutment stop 56 is preferably located as a safety stop to prevent a dangerous momentary gap from opening between scraper edge 40 and the ground when a sudden acute force is encountered forcing housing 14** in its second pivotal direction.

Figure 3:
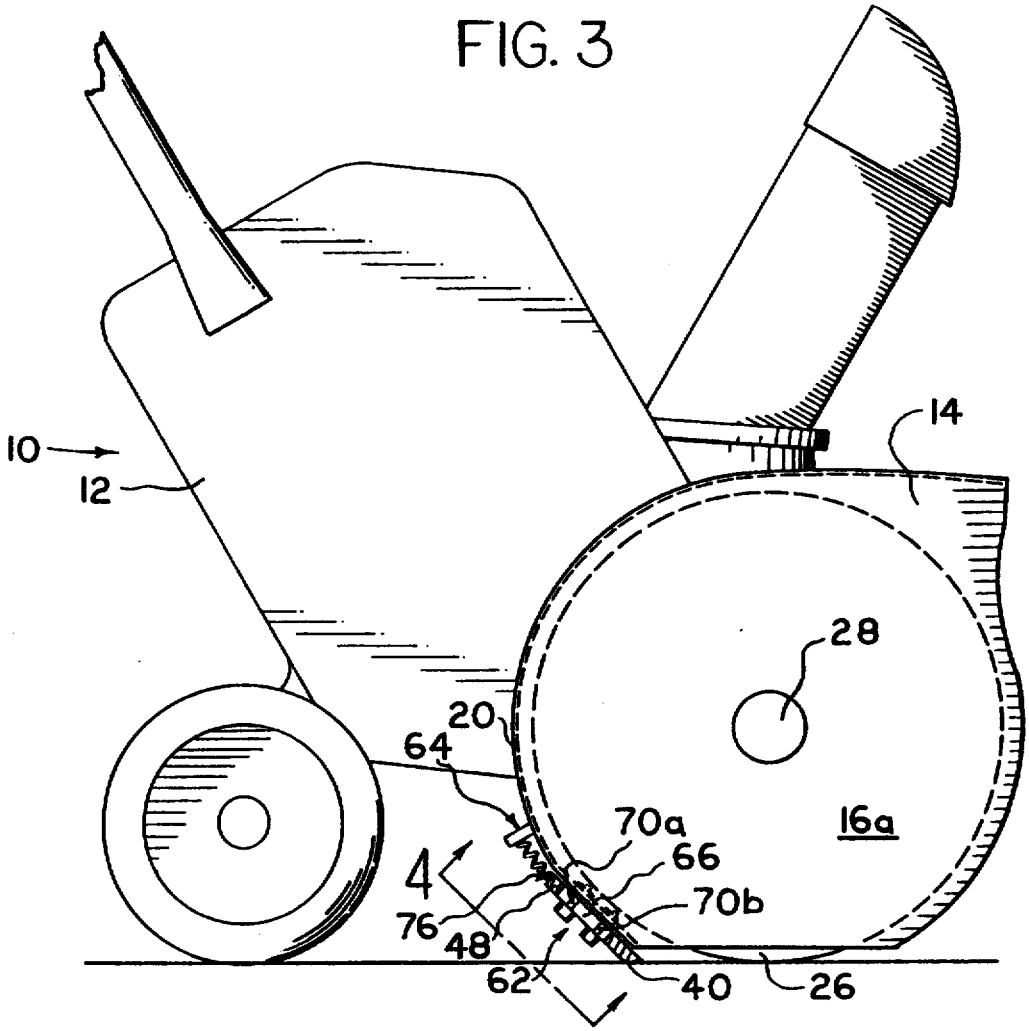
FIG. 3 is a side elevational view of a snowthrower formed in accordance with a second embodiment of the present invention.
Figure 4:
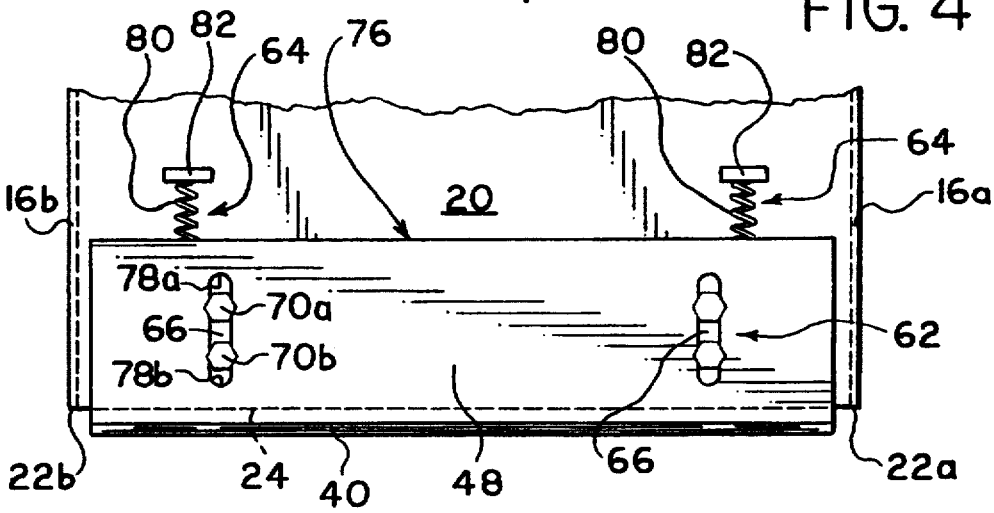
FIG. 4 is an elevational view thereof taken generally along line 4—4 in FIG. 3.

FIGS. 3 and 4 illustrate a second embodiment of the present invention which utilizes an alternative means to support and bias the scraper edge 40 for continuous contact with the ground. In the second embodiment, housing 14 is fixed to the snowthrower body 12 and does not pivot relative thereto. Rather, scraper guard plate 48 is slidably attached to rear wall 20 by an attachment means 62, and a biasing means 64 resiliently urges scraper guard plate 48 toward the ground so that scraper edge 40 is biased for continuous contact with the ground.

Attachment means 62 for slidably attaching scraper guard plate 48 to rear wall 20 generally comprises a plurality of elongated, generally vertical travel slots 66 in the scraper guard plate, each travel slot having a pair of headed guide pins **70*a* and 70*b* extending therethrough to connect the scraper guard plate to the rear wall. Although the number of travel slots 66 is shown to be two, it is contemplated that attachment means 62 may include a greater number of travel slots, as desired, with a correspondingly greater number of guide pins 70*a* and 70*b***, without straying from the scope of the invention.

Travel slots 66 are formed completely through scraper guard plate 48 such as by milling, and preferably extend from a region generally near scraper edge 40 to a region generally near a top edge 76 of the scraper guard plate, so as to provide scraper guard plate 48 with a suitably large range of movement to allow sufficient displacement of scraper guard plate 48 to maintain scraper edge 40 in continuous contact with the ground when changes in ground terrain are encountered. Motion of scraper guard plate 48 in a generally downward direction is limited by abutment of guide pin **70*a* with an upper closed slot end 78*a*, while motion of the scraper guard plate in a generally upward direction is limited by abutment of guide pin 70*b* with lower closed slot end 78*b*. Headed guide pins 70*a* and 70*b*, which may be studs or paired nuts and bolts having mating threads, preferably permit easy manual adjustment of the clamping force attaching scraper guard plate 48 to rear wall 20 to facilitate control of frictional resistance to sliding motion between scraper guard plate 48 and rear wall 20. The clamping force is preferably adjusted such that the frictional resistance neither renders biasing means 64 ineffective for moving scraper guard plate 48, nor prevents scraper guard plate 48 from sliding relative to rear wall 20 when scraper edge 40 encounters an unyielding obstruction or irregularity as snowthrower 10** is propelled forward.

In the second embodiment, biasing means 64 preferably comprises a plurality of coiled compression springs 80 mounted at one end to a spring mount 82 fixed to the exterior surface of rear wall 20 above scraper guard plate 48, and at the opposite end to the top edge 76 of scraper guard plate 48. The springs 80 are preferably spaced laterally so as to evenly distribute biasing force along the length of scraper guard plate 48 to ensure smooth travel of the scraper guard plate along its generally vertical travel path. The number of springs 80 employed as biasing means 64 is preferably two, however a greater number of springs may be used. The number of springs 80 used, and the stiffness of the springs, are preferably chosen to provide suitable resilient sliding motion of scraper guard plate 48 relative to rear wall 20.

Springs 80 are preferably in a state of intermediate loading or compression when snowthrower 10 is on flat ground. Further compression or loading of springs 80 occurs as scraper guard plate 48 is forced generally upward when scraper edge 40 encounters an unyielding obstruction or change in ground terrain, thereby allowing the snowthrower to traverse the obstruction. When scraper edge 40 encounters a trough or recess in the ground, the intermediately loaded springs urge scraper guard plate 48 generally downward to maintain scraper edge 40 in contact with the recessed ground.

What is claimed is:

1. An improved snowthrower comprising:

a body;

a housing connected to said body, said housing including a pair of spaced side walls, a rear wall, and a top wall cooperating to define a downwardly and forwardly projecting snow-receiving opening for said housing;

a chute opening through said top wall;

an auger carried by an axle mounted between said side walls for rotation about an axis, said auger extending partially downwardly through said snow-receiving opening for engagement with the ground;

drive means for rotating said auger to propel said snowthrower forward by continuous engagement of said auger with the ground and throwing snow from said housing through said chute;

a laterally extending bottom scraper edge carried by said rear wall; and biasing means for biasing said scraper edge for continuous contact with the ground, while permitting resilient displacement of said scraper edge responsive to ground terrain;

said housing being pivotally connected to said body by a generally U-shaped mounting bracket, said mounting bracket including a base portion fixed to said body and having opposite ends, and a pair of opposing leg portions extending one from each of said opposite ends, said axle being rotatably journalled by said leg portions, said housing being connected to said mounting bracket between said leg portions for pivotal motion about said axis, and said biasing means being connected to said housing and said mounting bracket for urging said housing about said axis in a first pivotal direction such that said scraper edge is biased for continuous contact with the ground, whereby a gap is prevented from opening between said scraper edge and the ground during forward motion of said snowthrower.

2. An improved snowthrower according to claim 1, wherein said scraper edge comprises a bottom edge of said rear wall.

3. An improved snowthrower according to claim 1, further including pivot safety stop means for limiting the range of pivotal motion of said housing about said axis.

4. An improved snowthrower according to claim 3, wherein said pivot safety stop means comprises a first abutment stop protruding from one of said pair of side walls to engage one of said pair of leg portions incident to pivotal motion of said housing in said first pivotal direction, and a second abutment stop protruding from one of said pair of side walls to engage one of said pair of leg portions incident to pivotal motion of said housing in a second pivotal direction opposite said first pivotal direction.

5. An improved snowthrower according to claim 1, wherein said biasing means comprises a plurality of compression springs each having a first end connected to said rear wall below said base portion, and a second end connected to said base portion.

* * * * *